United States Patent [19]

Smith

[11] Patent Number: 4,998,941

[45] Date of Patent: Mar. 12, 1991

[54] ADJUSTABLE DOOR STOP

[76] Inventor: B. Jack Smith, 8633 E. 79th St., Tulsa, Okla. 74133

[21] Appl. No.: 495,435

[22] Filed: Mar. 19, 1990

[51] Int. Cl.[5] ..... E05D 11/06

[52] U.S. Cl. ..... 16/375; 16/374

[58] Field of Search ..... 16/375, 376, 377, 374

[56] References Cited

U.S. PATENT DOCUMENTS

| | | | |
|---|---|---|---|
| 689,201 | 12/1901 | Koester . | |
| 747,570 | 12/1903 | Pickop . | |
| 1,455,550 | 5/1923 | Rodell . | |
| 1,644,249 | 10/1927 | Harrison . | |
| 2,133,351 | 10/1937 | Hansen | 16/375 |
| 2,280,655 | 4/1942 | Madsen | 16/191 |
| 2,592,230 | 4/1952 | Allen | 16/137 |
| 2,638,620 | 5/1953 | Civitelli | 16/375 |
| 2,813,293 | 5/1954 | Civitelli | 16/375 |
| 2,993,226 | 7/1961 | Baker et al. | 16/191 |
| 3,135,012 | 3/1962 | Wessel | 16/375 |
| 3,187,372 | 2/1963 | Parsons | 16/375 |
| 3,425,386 | 11/1966 | Campbell | 16/375 |
| 3,913,171 | 10/1975 | Reid | 16/375 |

*Primary Examiner*—Richard K. Seidel
*Assistant Examiner*—Chuck Y. Mah
*Attorney, Agent, or Firm*—Head & Johnson

[57] ABSTRACT

An adjustable door stop for a hinge mounted door having at least one hinge leaf connected to the door, one hinge leaf connected to a doorway, and a hinge pin. A body receives the hinge pin in order to rotate substantially perpendicular to the axis of the hinge pin. An adjustable mechanism extends from the body and rests against the doorway. A finger extends from the body substantially parallel to the axis of the hinge pin so that the hinge leaf connected to the door may rest against the finger, thereby stopping movement of the door.

4 Claims, 2 Drawing Sheets

ADJUSTABLE DOOR STOP

BACKGROUND OF THE INVENTION

1. Field of the Invention

The present invention relates to an adjustable door stop that may be utilized with existing hinge mounted doors. In particular, the present invention relates to an adjustable door stop for hollow core doors that will not mar or damage the door.

2. Prior Art

Door stops are well known devices used to prevent opening doors from causing damage to doors, door knobs, or adjacent walls. While some door stops require special hinge leaves or hinge pins, the present invention is directed to a door stop that may be added to standard, existing, hinge mounted doors.

One popular type of door stop is held in place by a hinge pin and includes a padded, adjustable post that rests against the doorway and a padded post that rests against the door. Many of the doors in use today are hollow core doors with only a thin exterior. Continual pressure against the door by the post resting against the door will result in damage to the door.

A patent search has been conducted and the Applicant is aware of the following U.S. Patents:

| U.S. Pat. No. | Patentee | Issue date |
|---|---|---|
| 689,201 | Koester | Dec. 17, 1901 |
| 747,570 | Pickop | Dec. 22, 1903 |
| 1,455,550 | Rodell | May 15, 1923 |
| 1,644,249 | Harrison | Oct. 4, 1927 |
| 2,993,226 | Baker et al | July 25, 1961 |
| 2,280,655 | Madsen | April 21, 1942 |
| 2,592,230 | Allen | April 8, 1952 |

Koester (U.S. Pat. No. 689,201), Pickop (U.S. Pat. No. 747,570), Rodell (U.S. Pat. No. 1,455,550), Harrison (U.S. Pat. No. 1,644,249), and Baker et al (U.S. Pat. No. 2,993,226) each show examples of door stops requiring specially constructed or adapted hinge leaves or hinge pins in order to operate.

Madsen (U.S. Pat. No. 2,280,655) discloses a flange extending from a plate received on the hinge pin. The stop is not adjustable, however, and limits the opening of the door to a single position. The stop is also not reversible, that is it may not be used with either left or right opening doors.

Allen (U.S. Pat. No. 2,592,230) discloses a pair of plates mounted on the hinge pin. The plates have a series of aperatures which receive a pin in order to lock the plates in place and impact against the opening door.

Accordingly, it is a principal object and purpose of the present invention to provide an adjustable door stop that will not impact against the door in order to prevent damage to the door.

It is a further object and purpose of the present invention to provide an adjustable door stop that may be added to and utilized with various hinge mounted doors.

SUMMARY OF THE INVENTION

The adjustable door stop includes a body which has a central aperture passing through the body in order to receive a hinge pin therethrough. The diameter of the aperature will be slightly larger than the diameter of the hinge pin so that the body will be free to rotate about the axis of the hinge pin.

Extending radially from the body of the door stop is an arm which terminates in a threaded opening. A threaded post is received in the opening and terminates in a padded stop in order to rest against a doorway.

A finger extends somewhat radially from the body of the door stop. The finger also extends both above and below the body of the door stop substantially parallel to the axis of the hinge pin.

As the door is moved from a closed position to an open position, the body of the door stop will begin to rotate about the axis of the hinge pin. The door stop will rotate until the padded stop comes into contact with the doorway, after which the door stop will cease any further movement. The door may continue to open until the hinge leaf secured to the door comes into contact with the finger.

DETAILED DESCRIPTION OF THE PREFERRED EMBODIMENTS

Figure 2:
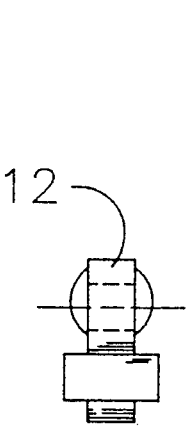
FIG. 2 is a side view of the adjustable door stop shown in FIG. 1.
Figure 1:
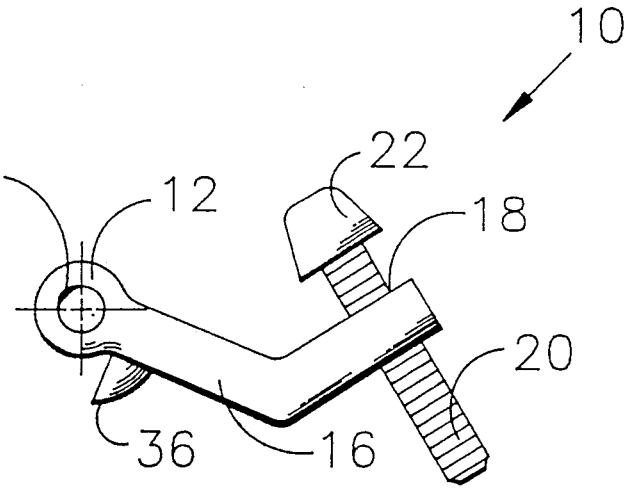
FIG. 1 is a top view of an adjustable door stop constructed in accordance with one embodiment of the present invention.

Referring to the drawings in detail, FIGS. 1 and 2 show a door stop 10 apart from its use with a hinge mounted door.

The door stop includes a body 12 which has a central aperture 14 passing through the body. As will be seen, the central aperture will receive a hinge pin (not shown in FIGS. 1 or 2). The diameter of the aperture is slightly larger than the diameter of a typical hinge pin so that the body is free to move with respect to the hinge pin. The aperture 14 is located so that the body 12 will be allowed to rotate about the axis of the hinge pin. The rotation of the body will, therefore, be substantially perpendicular to the axis of the hinge pin.

Extending radially from the body of the door stop 10 is an arm 16, which terminates in a threaded opening 18. A threaded post 20 is received in the opening 18 and terminates in a padded stop 22, capable of resting against a doorway 24 (not shown in FIGS. 1 or 2). As will be appreciated, as the threaded post is turned counter clockwise, the distance between the padded stop 22 and the arm 16 increases. Conversely, as the post 20 is turned clockwise, the distance between the padded stop and the arm decreases.

Figure 3:
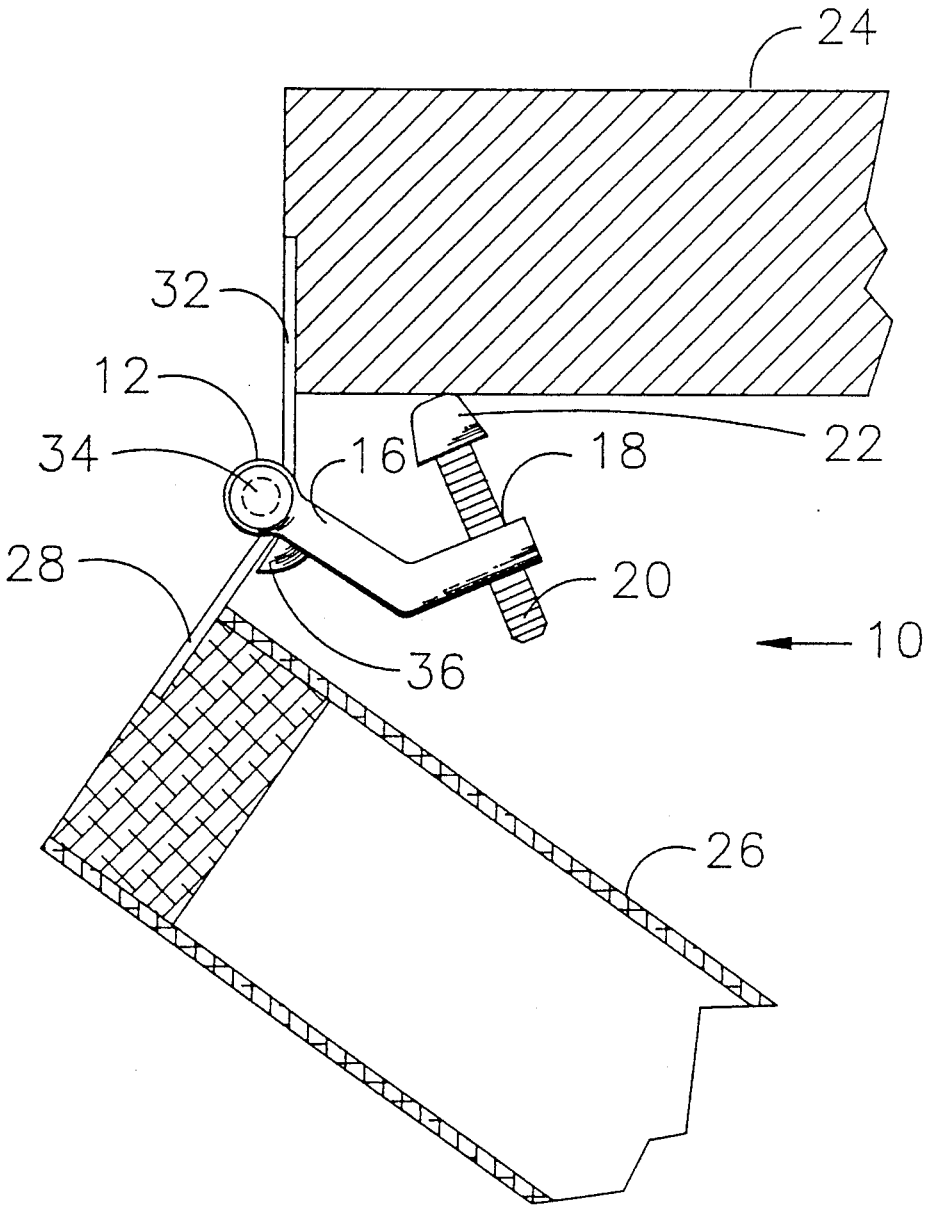
FIG. 3 is a perspective view of the adjustable door stop shown in FIG. 1 installed with a hinge mounted door.

FIG. 3 shows the door stop 10 installed with a hollow core door 26. As is depicted, hollow core doors have solid edges but are primarily composed of two opposing, thin faces. This construction makes the doors light in weight and inexpensive to produce.

A hinge leaf 28 is secured to the door 26 in any typical fashion, such as with screws 30. Another hinge leaf 32 is secured to the doorway 24 in any typical fashion, such as with screws 30. The hollow core door 26, hinge leaves 28 and 32, and hinge pin 34 are standard items which do not form a part of the invention.

With a hinge pin 34 in place through the aperture 14, the body 12 is held in place between the hinge leaves 28 and 32 and the top of the hinge pin 34. Thus, vertical movement of the body 14 is prevented although rotational movement is permitted.

As seen in FIGS. 1, 2, and 3, a finger 36 extends somewhat radially from the body 12 of the door stop. The finger also extends both above and below the body substantially parallel to the hinge pin 34.

The operation of the door stop will be appreciated from a consideration of FIG. 3. The door stop 10 is shown with a doorway and attached wall which is aligned with the door so that the door would open 180 degrees in the absence of any stop mechanism. As the door 26 is moved from a closed position to an open position, the body of the door stop 10 will begin to rotate about the axis of the hinge pin. The door stop will rotate until the padded stop 22 comes into contact with the doorway 24, after which the door stop will cease any further movement. The door 26 may continue to open until the hinge leaf 28, secured to the door 26, comes into contact with the finger 36. The hinge leaf 28 will then be prevented from moving any further and, accordingly, the door will not open past that point, as seen in FIG. 3 Since the finger 36 impacts against the hinge leaf 28 only, no damage will be done to the door.

The door stop is also adjustable to vary the amount that the door will open. If the distance between the end of the padded stop 22 and the arm is increased by unscrewing the post 20 from the opening, the arm will be distanced from the doorway and the finger 36 will be repositioned to allow the door to open less.

The present invention is advantageous in that it may be installed when the door and accompanying hinges are installed or it may be added later. The installation of the door stop on an existing door can be seen in FIG. 4. The hinge pin 34 is removed from the hinge leaves 28 and 32. The hinge pin is then inserted through the central aperture 14 of the body, after which the hinge pin is replaced. The threaded post 20 will then be adjusted by screwing or unscrewing the post to select a desired maximum door opening.

Figure 4:
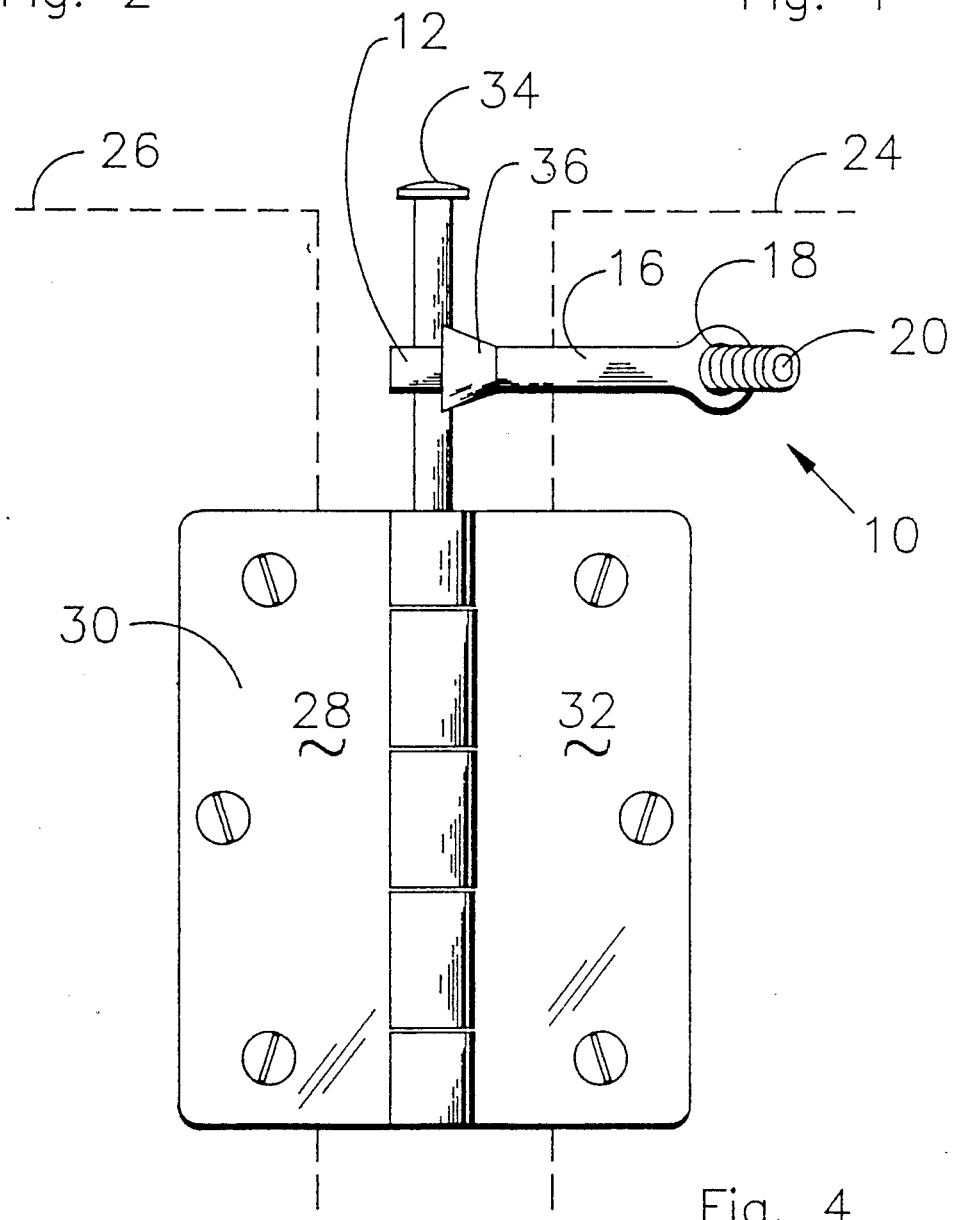
FIG. 4 is a side view of the adjustable door stop shown in FIG. 1 during installation or removal of the door stop from a hinge mounted door.

Since the finger 36 extends both above and below the body 12, the door stop may be used with both right-hand and left-hand opening doors. Although the door stop is shown in FIGS. 3 and 4 with a right-hand opening door, it could easily be used with a left-hand opening door.

Whereas, the present invention has been described in particular relation to the drawings attached hereto, it should be understood that other and further modifications, apart from those shown or suggested herein, may be made within the spirit and scope of this invention.

What is claimed is:

1. An adjustable door stop for a hinge mounted door having at least one hinge leaf connected to said door, at least one hinge leaf connected to a doorway, and a hinge pin, which door stop comprises: a body having means to receive said hinge pin therethrough so that said body may rotate substantially perpendicular to the axis of said hinge pin; adjustable means extending from said body to rest against said doorway; and a finger extending from said body adjacent to said means to receive said hinge pin, said finger substantially parallel to the axis of said hinge pin so that upon opening of said door, said finger will contact and rest upon said hinge leaf connected to said door, arrest movement of said hinge leaf, and thereby stop movement of said door without said door stop contacting said door.

2. An adjustable door stop as set forth in claim 1 wherein said adjustable means includes a threaded post received in a threaded opening so that adjustment of said threaded post will cause the position of said finger to be varied, thereby varying the opening of said door.

3. An adjustable door stop as set forth in claim 1 wherein said means to receive said hinge pin includes a central aperture through said body.

4. An adjustable door stop as set forth in claim 1 wherein said finger extends both above and below said body so that said door stop may be used for either right opening or left opening doors.

* * * * *